US005398015A

United States Patent [19]

Kudo et al.

[11] Patent Number: 5,398,015

[45] Date of Patent: Mar. 14, 1995

[54] DELAY BREAKING FUSE

[75] Inventors: Toshiharu Kudo; Mitsuhiko Totsuka, both of Shizuoka, Japan

[73] Assignee: Yazaki Corporation, Tokyo, Japan

[21] Appl. No.: 159,588

[22] Filed: Dec. 1, 1993

[30] Foreign Application Priority Data

Dec. 1, 1992 [JP] Japan ..... 4-088270 U

[51] Int. Cl.[6] ..... H01H 85/14

[52] U.S. Cl. ..... 337/255; 337/268

[58] Field of Search ..... 337/166, 186, 187, 188, 337/195, 196, 197, 198, 276, 278, 280, 295, 296, 163, 255, 268

[56] References Cited

U.S. PATENT DOCUMENTS

| | | | |
|---|---|---|---|
| 4,570,147 | 2/1986 | Ebi | 337/186 |
| 4,646,052 | 2/1987 | Matsunaga et al. | 337/186 |
| 4,672,352 | 6/1987 | Takano | 337/260 |
| 4,751,490 | 6/1988 | Hatagishi | 337/295 |
| 4,871,990 | 10/1989 | Ikeda et al. | 337/238 |
| 4,944,084 | 7/1990 | Horible et al. | 337/296 |

FOREIGN PATENT DOCUMENTS 62-180852 11/1987 Japan .

*Primary Examiner*—Lincoln Donovan

*Attorney, Agent, or Firm*—Sughrue, Mion, Zinn, Macpeak & Seas

[57] ABSTRACT

An inexpensive delay-breaking fuse which assures that when an electric current having an intensity in excess of a value representing a steady-state current such as a motor lock electric current or the like flows through the delay-breaking fuse, durability of the fuse is left unchanged, a stable prearching time/current characteristic is maintained, and moreover, there does not arise a malfunction that a housing is thermally deformed or the color of the housing is changed to other one. The delay-breaking fuse includes a fuse element having a pair of female terminal portions arranged on the opposite sides thereof with an electrical conductive melting portion having a reduced width bridged therebetween with a melting/breaking part located at the intermediate position of the electrical conductive melting portion. A pair of heat radiating plates are projected upward of the upper end edge of a base plate integrated with the female terminal portions in order to radiate heat from the electrical conductive melting portion. The heat radiating plates are caused to extend from the upper end edge of the base plate while they are located adjacent to the electrical conductive melting portion.

10 Claims, 4 Drawing Sheets

DELAY BREAKING FUSE

BACKGROUND OF THE INVENTION

1. Field of the invention

The present invention relates to a delay-breaking fuse preferably employable for protecting an electric motor such as a power window motor for an automobile or the like.

2. Related art

For example, in the case of a load circuit for an electric motor, an excessively high intensity of electric current instantaneously flows along the load circuit just at a point of time when a highest intensity of electric current reaches a certain value enlarged several times at the time of starting of rotation of the motor compared with the value representing an intensity of electric current at the time of a steady state load. In addition, in the case of a power window motor, a motor lock current flows along a load circuit for the motor with a high intensity enlarged several times compared with the intensity of an electric current at the time of a steady state load current of the motor, when window glasses of an automobile are fully closed or opened. Thus, an electric current frequently flows along the load circuit with an intensity in excess of the value representing a steady-state current value even though an abnormality such as a short circuit or the like occurs. In the circumstances as mentioned above, many requests have been raised from users for providing a delay-breaking fuse having excellent operating characteristics which assures that it is not molten and broken on receipt of an electric current simultaneously having a high intensity in excess of the value corresponding to a steady-state electric current, a motor lock current or the like, and moreover, it can reliably shut off an excessively high intensity of electric current at the time of slight short circuit.

With the delay-breaking fuse of the foregoing type, however, when an electric current having an intensity in excess of the value corresponding to a steady-state current such as a motor lock electric current or the like frequently flows along the load circuit, the temperature of an electric conductive melting portion of the fuse is elevated due to repeated feeding of the motor lock current or the like, resulting in a melting/breaking part of the electrical conductive melting portion being molten and broken. Consequently, the fuse can not practically be used for a long time. In other words, running life of the fuse is undesirably shortened.

In view of the foregoing malfunction, a proposal has been made with respect to a cartridge type delay-breaking fuse as shown in FIG. 5 and FIG. 6 wherein a fusible link 51 serving as a delay-breaking fuse includes a electrical conductive melting portion 54 composed of a fuse element 52 and a melting/breaking part 53, and heat radiating plates 56 are connected to female terminal portions 55 in the face-to-face relationship while the heat radiating plates 56 and the female terminal portions 55 are firmly held between a housing 57 and a resilient clamping arm 60 in the clamped state (cf. Unexamined Japanese Utility Model Application No. 62-180852).

The fuse element 52 is received in the housing 57 for the fusible link 51, and it is then fitted onto a pair of male terminals 58 standing upright from., e.g., an electrical connecting box (not shown).

The fuse element 52 is made of an electrical conductive metallic plate to build a substantially U-shaped integral structure. As shown in FIG. 6, each female terminal portion 55 is composed of a wide base plate 59 integrated with the electrical conductive melting portion 54 and a resilient clamping arm 60 of which opposite ends are inwardly bent. The electrical conductive melting portion 54 is bent to exhibit a substantially inverted U-shaped contour having the melting/breaking part 53 located at the central position thereof. With this construction, while the base plate 59 is outwardly oriented, a pair of female terminal portions 55 are located opposite to each other. The heat radiating plate 56 attached to the female terminal portion 55 is made integral with the base plate 59 which is folded on the male terminal 58 inserting side.

Since the fusible link 51 is constructed in the abovedescribed manner, heat radiation can effectively be achieved in the presence of the heat radiating plates 56, although the temperature of the electrical conductive melting portion 54 is elevated due to repeated feeding of the motor lock electric current. Thus, the melting/breaking part 53 is molten and broken with difficult in spite of the repeated feeding of the motor lock current. This leads to the result that durability of the fusible link 51 can substantially be improved.

However, since the fusible link 1 is constructed such that each heat radiating plate 56 is made integral with the base plate 59 by folding the latter, and the thus folded heat radiating plate 56 comes in close contact with the base plate 59 extending from the electrical conductive melting portion 54 while it is located on an electric current circuit extending from one female terminal portion 55 to other female terminal portion 55 via the electrical conductive melting portion 54, there arises a malfunction that the resistance value of the electric current flowing via the electrical conductive melting portion 54 is largely affected by the heat radiating plates 56. Thus, it is practically difficult that the fuse element 52 obtains a desired pre-arching time/current characteristic because the resistance value of the electrical conductive melting portion 54 largely fluctuates.

The fuse element 52 is made to build an integral structure by punching a band-shaped electrical conductive metallic plate. However, since each heat radiating plate 56 extends across the length of the male terminal 58 inserting side of the female terminal portion 55, the whole length of the fuse element 52 to be punched is elongated by a quantity corresponding to twice extensions of the heat radiating plate 56, i.e., the length of two heat radiating plates 56. Thus, there arises a necessity for preparing a band-shaped electrical conductive metallic plate having a wide width, resulting in a production cost required for forming the fuse element 52 being undesirable increased.

When the fuse element 52 is received in the housing 57, each heat radiating plate 56 is held between the inner wall surface of the housing 57 and the base plate 59 in the clamped state, causing the heat radiated from the heat radiating plates 56 to be easily conducted to the inner wall of the housing 57. Thus, there is a possibility that the housing 57 is thermally deformed due the elevated temperature of the housing 57 itself or the color of the housing 57 is changed to other one.

SUMMARY OF THE INVENTION

The present invention has been made in consideration of the aforementioned background and its object resides in providing a delay-breaking fuse which assures that when an electric current having an intensity in excess of the value corresponding to a steady-state current such as a motor lock electric current or the like frequently flows through the delay-break, stable durability of the delay-breaking fuse is left unchanged, and moreover, there does not arise a malfunction that a housing of the delay-fusible fuse is thermally deformed or the color of the housing is changed to other one due to an elevated temperature of the housing itself.

To accomplish the above object, the present invention provides a delay-breaking fuse including a pair of electric connecting portions on the opposite sides of an electric conductive melting portion having a reduced width with a melting/breaking part located at the intermediate position of the electric conductive metallic portion made of an electric conductive metallic plate to build an integral structure, wherein a plurality of heat radiating plates integrated with one of the electric connecting portions to radiate heat from the electric conductive melting portion are projected from the end edge of one of the electric connecting portions located on the electric conductive melting portion side.

When each of the heat radiating plates is prepared by forming a number of heat radiating fins by cutting out a part of each heat radiating plate and then bending a number of cutout portions, a heat radiating efficiency of each heat radiating plate can be elevated.

Since the late-breaking fuse is constructed in the above-described manner, since the heat radiating plates are not located on a circuit for flowing an electric current from one of the electric connecting portions to other one, the resistance value of the electric current flowing past the electric conductive melting portion is not adversely affected by the heat radiating plates.

In addition, since each heat radiating plate is made of an electric conductive metallic plate by utilizing an unused part of the electric conductive metallic plate appearing after it is punched out to form the electric conductive melting portion having a reduced width, there does not arise a malfunction that the total length of a fuse element formed by a punching operation is undesirably elongated by a quantity corresponding to the arrangement of the heat radiating plates.

When the fuse element having the heat radiating plates arranged therein is received in a housing, the heat radiating plates do not come in contact with the inner wall of the housing.

DETAILED DESCRIPTION OF THE PREFERRED EMBODIMENTS

The present invention will now be described in detail hereinafter with reference to the accompanying drawings which illustrate a few preferred embodiments thereof.

Figure 1:
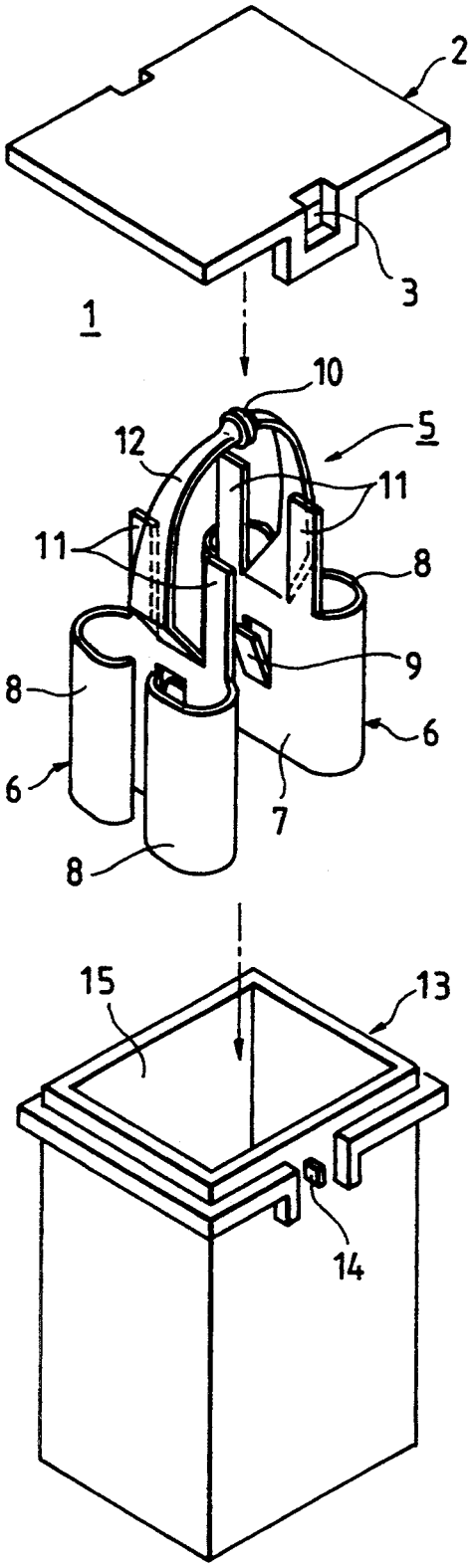
FIG. 1 is a perspective view of a fusible link constructed according to an embodiment of the present invention.
Figure 2:
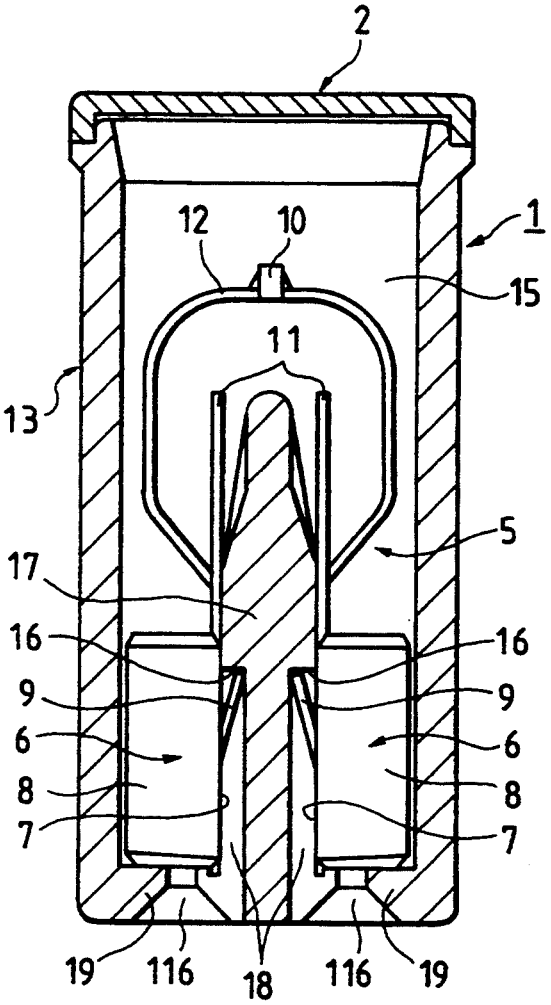
FIG. 2 is a vertical sectional view of the fusible link shown in FIG. 1.

FIG. 1 is a perspective view of a cartridge type delay-breaking fuse constructed according to an embodiment of the present invention, particularly showing essential components constituting the delay-breaking fuse in the disassembled state, and FIG. 2 is a vertical sectional view of the delay-breaking fuse shown in FIG. 1. It should be noted that the cartridge type delay-breaking fuse is constructed in the form of a fusible link designated by reference numeral 1 in the drawings.

The fusible link 1 includes as essential components an electrical insulative housing 13, a fuse element 5 received in the housing 13, and a cover 2 molded of a transparent synthetic resin so as to allow the housing 13 to be closed therewith.

The fuse element 5 is made of an electric conductive metallic plate to build an inverted U-shaped integral structure, and a pair of female terminal portions 6 each serving as a connecting portion are composed of a pair of wide base plates 7 each extending downward of an electrical conductive melting portion 12 having a reduced width and a pair of resilient clamping arms 8 each of which opposite ends are formed by curvedly folding the base plate 7. As is apparent from the drawings, the electrical conductive melting portion 12 is prepared in the inverted U-shaped contour while a melting/breaking part 10 made of a low temperature melting alloy is located at the central position of the electrical conductive melting portion 12. Both the female terminal portions 6 are located opposite to each other while the base plate 7 defining each female terminal portion 6 is inwardly oriented. An opposing pair of slantwise upward extending lances 9 are formed by cutting out and then bending a part of each base plate 7. In addition, a pair of rectangular heat radiating plates 11 are formed on the base plate 7 on the opposite sides of the electrical conductive melting portion 12 with the electrical conductive melting portion 12 located therebetween while extending upward of the upper end edge of the base plate 7. Incidentally, the heat radiating plate 11 may be formed on the resilient clamping arm 8 on the electrical conductive melting portion 12 side while extending upward of the upper end edge of the resilient clamping arm 8.

The heat radiating plates 11 located on the opposite sides of the electrical conductive melting portion 12 are caused to extend from the base plate 7 in the upward direction, they are formed to extend in parallel with the electrical conductive melting portion 12 on the opposite sides of the electrical conductive melting portion 12 positionally corresponding to an unused part of the band-shaped electrical conductive plate which has been hitherto punched out to form the conventional electrical conductive melting portion having a reduced width. With this construction, there does not arise a malfunction that the whole length of the punched fuse element 5 is elongated by a quantity corresponding to twice extensions of the heat radiating plates 11, i.e., a length of two heat radiating plates 11. Thus, since the raw material required for the base plate 7 can effectively be utilized, the production cost of the fuse element 5 can be reduced.

As shown in FIG. 2, the housing 13 is molded of a heat resisting synthetic resin by employing an injection molding process. Specifically, the housing 13 includes a hollow receiving space 15 having a depth approximately equal to a half of the height of the housing 13 in the upper half region thereof and the upper end of the hollow receiving space 15 is kept open to the outside to receive the electrical conductive melting portion 12 of the fuse element 5. A lower half of the housing 13 is divided into two chambers, i.e., two receiving chambers 18 corresponding to a pair of female terminal portions 6 for the fuse element 5 with a partition wall 17 located therebetween. A pair of stepped engagement portions 16 adapted to be engaged with the lances 9 so as to prevent the fuse element 5 from being disconnected from the fusible link 1 are formed on the opposite side wall surfaces of the partition wall 17 facing to the base plates 7. A pair of holes 116 are formed through a bottom wall 19 of the receiving chambers 18 in such a manner as to serve as a stopper wall when the fuse element 5 is received in the housing 13.

The cover 2 is likewise molded of a synthetic resin by employing an injection molding process and includes a pair of engagement recesses 3 adapted to be engaged with a pair of cover engagement protuberances 14 formed at the upper end of the housing 13. Thus, when the cover 2 is fitted to the upper open end of the housing 13 with the cover engagement protuberances 14 received in the engagement recesses 3, the receiving space 15 of the housing 13 is closed with the cover 2.

The fusible link 1 is fitted to a fuse box (not shown) in such a manner that tab type male terminals projecting outside of the surface of the fuse box are inserted into the receiving chambers 18 through the holes 116 of the bottom wall 19 until they are connected to the female terminal portions 6.

Since heat is effectively radiated from the heat radiating plates 11 arranged for the fuse element 5 of the fusible link 1, the pre-arcing time/current characteristic of the fusible element 5 is delayed. Thus, in the case that an electric current having an intensity in excess of the value representing an intensity of steady-state current frequently flows through the fusible link 1, the melting/breaking part 10 is less liable to be molten and broken, resulting in an increased durability of the fuse element 5, i.e., the fusible link 1 being improved. Since the heat radiating plates 11 are prepared in the form of cantilever-like pieces extending substantially in parallel with the electrical conductive melting portion 12 having a reduced width, and moreover, they are not located on a circuit for an electric current flowing from one female terminal portion 6 to other female terminal portion 6 via the electrical conductive melting portion 12, the resistance value of the electric current flowing past the electrical conductive melting portion 12 is not thermally affected by the heat radiating plates 11. In other words, the resistance value of the electrical conductive melting portion 12 is kept stable regardless of the presence of the heat radiating plate 11. This makes it easy for the fuse element 5 to obtain a desired pre-arcing time/current characteristic.

In addition, since the heat radiating plates 11 are projected toward the receiving space 15 in the upper half region of the housing 13 without any contact with the inner wall of the housing 13 when the fuse element 5 is received in the housing 13, the heat radiated from the heat radiating plates 11 is conducted to the housing 13 with difficulty. Thus, there does not arise a malfunction that the housing 13 is thermally deformed due to exposure to a high temperature, and moreover, the color of the housing 13 is changed to other one.

Figure 3:
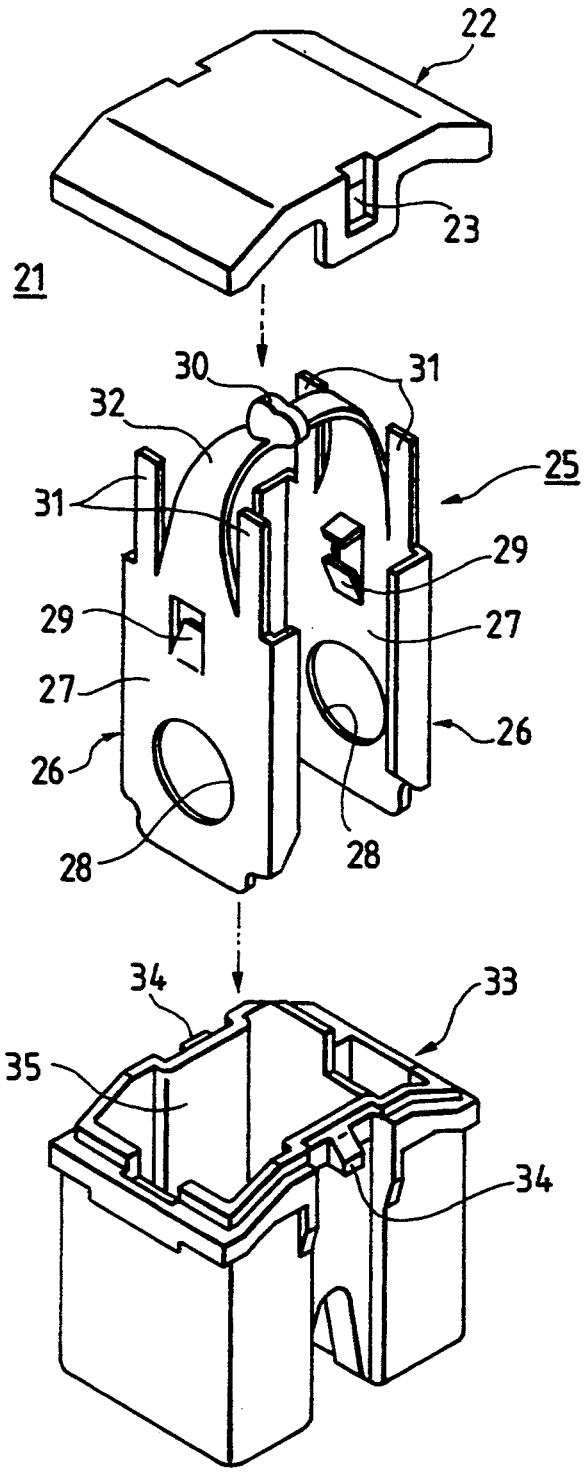
FIG. 3 is a perspective view of a fusible link constructed according to another embodiment of the present invention.

FIG. 3 is a perspective view of a cartridge type delay-breaking fuse constructed according to another embodiment of the present invention, particularly showing essential components constituting the delay-breaking fuse in the disassembled state. It should be noted that the delay-breaking fuse is constructed in the form of a fusible link designated by reference numeral 21.

The fusible link 21 includes as essential components an electrical insulative housing 33, a fuse element 25 received in the housing 33, and a cover molded of a transparent synthetic resin so as to allow the housing 33 to be closed therewith.

The fuse element 25 is made of an electric conductive metallic plate to build an inverted U-shaped integral structure, and a pair of connecting plates 27 each serving as a flat plate-shaped electrical connecting portion are connected to each other via an electrical conductive melting portion 32 having a reduced width. The electrical conductive melting portion 32 is curvedly bent in the inverted U-shaped contour while a melting/breaking part 30 disposed at the intermediate position of the electrical conductive portion 32 is located at a summit of the electrical conductive portion 32. The connecting plates 27 are caused to extend from the bottom of the housing 33 in parallel with each other.

To assure that a cable connecting bolt is inserted through the fuse element 25, bolt holes 28 are formed through the connecting plates 27 at the positions in the vicinity of the bottom of the housing 33, and slantwise upward extending resilient engagement pieces 29 are formed on the connecting plates 27 in such a manner as to serve as disconnection preventing means when the fuse element 25 is received in the housing 33. In addition, a pair of rectangular plate-like heat radiating plates 31 are caused to extend upward of the upper end edge of each connecting plate 27 while the electrical conductive melting portion 32 is located therebetween.

The heat radiating plates 31 are arranged to extend upward of the upper end edge of each connecting plate 27 while they are located adjacent to the electrical conductive melting portion 32. Thus, when the fuse element 25 is punched out from an electrical conductive metallic plate, the heat radiating plates 31 are formed to extend in parallel with each other on the opposite sides of the electrical conductive melting portion 32 corresponding an unused part of an electrical conductive metallic plate which has been hitherto punched out to form the conventional electrical conductive melting portion having a reduced width. Consequently, a production cost required for the fuse element 25 can be reduced in the same manner as the fuse element 5 in the preceding embodiment.

The housing 33 is molded of a heat resisting synthetic resin by employing an injection molding process, and a receiving space 35 of which upper end is kept opened to the outside is formed in the upper half region of the housing 33 having a depth corresponding to about a half of the height of the housing 33 so as to receive the electrical conductive melting portion 32 of the fuse element 25 therein. In addition, a pair of connecting plate insert holes (not shown) are formed through the bottom wall of the housing 33 so as to enable the connecting plate 27 to be inserted therethrough.

The cover 22 is likewise molded of a synthetic resin by employing an injection molding process, and a pair of engagement recesses 23 are formed on the cover 22 to be engaged with a pair of cover engagement protuberances 34 on the upper end of the housing 33. Thus, when the cover 22 is fitted to the housing 33, the cover engagement protuberances 34 are engaged with the engagement recesses 23 so that the hollow space 35 of the housing 33 is closed with the cover 22.

The fusible link 21 is fitted to a fusible link fitting box (not shown) so that a cable is connected to the fusible link 21 via the bolt holes 28.

With this construction, durability of the fuse element 25 received in the fusible link 21 can be improved in the same manner as the fuse element 5 in the preceding embodiment. This makes it easy for the fuse element 25 to obtain a desired prearcing time/current characteristic. Thus, there does not arise a malfunction that the housing 33 is thermally deformed due to exposure to a high temperature, and moreover, the color of the housing 33 is changed to other one.

Figure 4A:
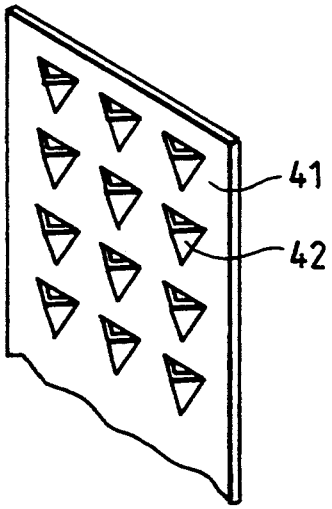
FIG. 4(*a*) to (*c*) are perspective views, respectively, each of which show by way of example a heat radiating plate constructed according to a modified embodiment of the present invention.
Figure 4B:
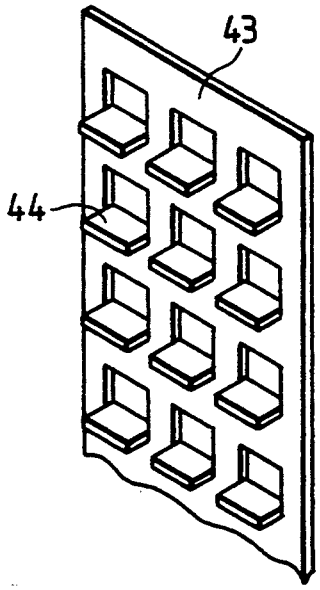
Figure 4C:
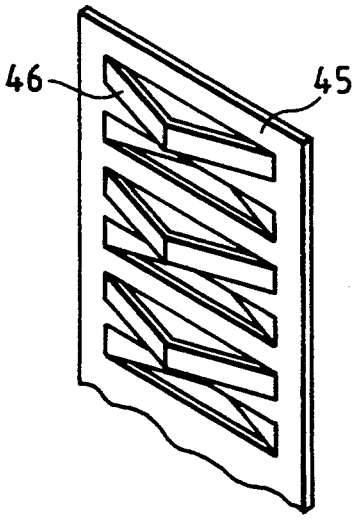
Figure 5:
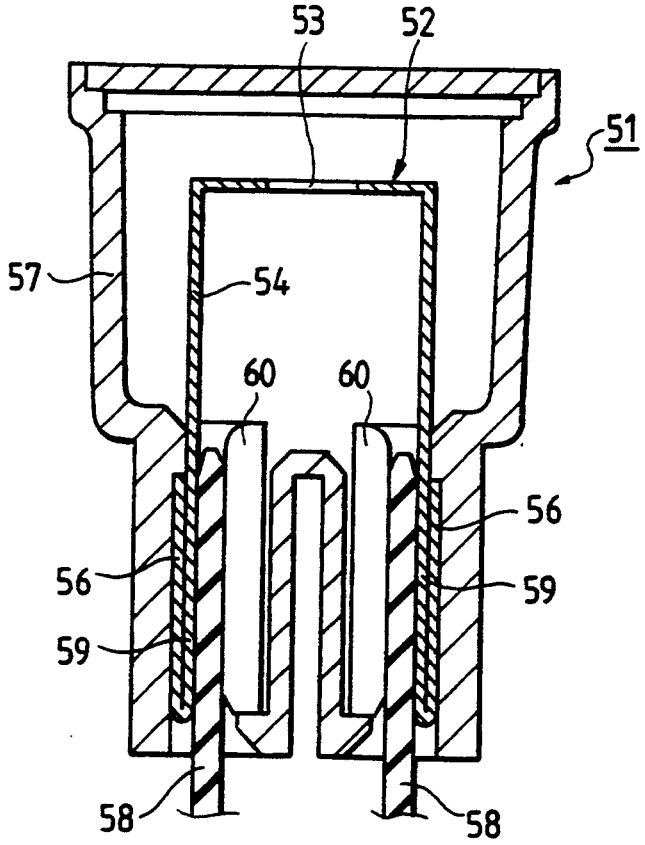
FIG. 5 is a vertical sectional view of a conventional fusible link.
Figure 6:
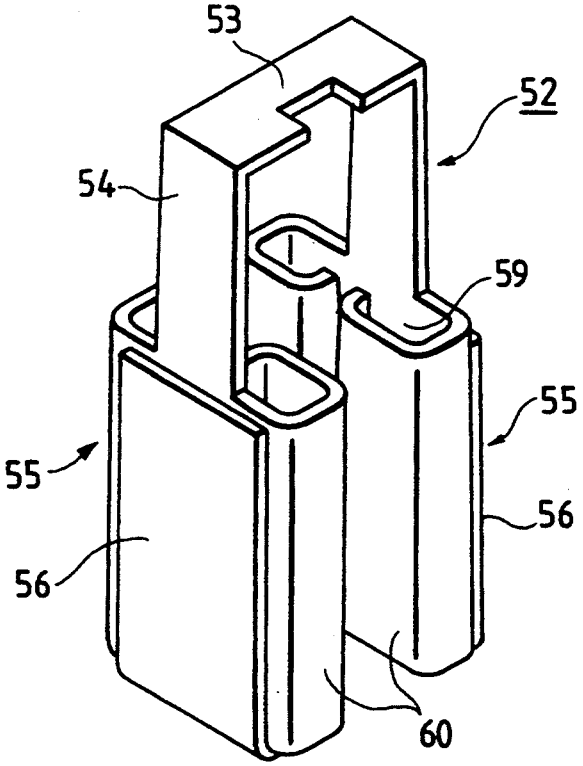
FIG. 6 is a perspective view of the conventional fusible link shown in FIG. 5.

FIG. 4 is enlarged fragmentary perspective views, respectively, each of which shows by way of example the structure of a heat radiating plate constructed according to a modified embodiment of the present invention wherein a number of fins are formed on the heat radiating plate by cutting out a part of the heat radiating plate in the form of fins and then bending them in order to elevate a heat radiating efficiency of the heat radiating plates.

A number of triangular conical heat radiating fins 42 are formed on a heat radiating plate 41 shown in FIG. 4(*a*), a number of rectangular heat radiating fins 44 are formed on a heat radiating plate 43 shown in FIG. 4(*b*), and a number of triangularly bent heat radiating fins 46 are formed on a heat radiating plate 45 shown in FIG. 4(*c*) by way of the same steps as mentioned above. When a number of heat radiating fins are formed on the heat radiating plate in the above-described manner, a heat radiating efficiency of the delay-breaking fuse can be elevated compared with the heat radiating efficiency obtainable with each of the rectangular flat plate-shaped heat radiating plates 11 and 31 in the preceding embodiments of the present invention.

It should of course be understood that the present invention should not be limited to the contour preset to each of the fuse element, the housing and the heat radiating plate but various types of contours may be employed for them.

As described above, according to the present invention, the delay-breaking fuse is constructed such that a pair of electrical connecting portions are arranged on the opposite sides of an electrical conductive melting portion having a reduced width with a melting/breaking part disposed at the intermediate position thereof, and a pair of heat radiating plates are projected from the upper end edges of the electrical connecting portions to radiate heat from the electrical conductive melting portion.

Since the heat radiating plates are not located on a circuit for flowing an electric current from one electrical connecting portion to other electrical connecting portion via the electrical conductive melting portion, and moreover, the resistance value of an electrical current flowing past the electrical conductive melting portion is not adversely affected by the heat radiating plates, the resistance value of electrical conductive melting portion is kept stable regardless of the arrangement of the heat radiating plates. This makes it easy for the delay-breaking fuse to obtain a desired pre-arcing time/current characteristic. In addition, since the heat radiating plates are formed by utilizing a part of the electrical conductive metallic plate to be punched out to form the electrical conductive melting portion having a reduced width corresponding to an unused part of the same, there does not arise a malfunction that the total length of the punched fuse element is elongated by a quantity of twice extensions of the heat radiating elements arranged in the housing. Thus, the raw material required for the electrical conductive melting portion can effectively be utilized, resulting in the production cost of the fusible link being reduced. When the fuse element having the heat radiating plates arranged therein is received in the housing, the heat radiating plates do not come in contact with the inner wall of the housing, causing the heat radiated from the heat radiating plates to be conducted to the housing with difficult. Thus, there does not arise a malfunction that the housing is thermally deformed due to exposure to a high temperature, and moreover, the color of the housing is changed to other one.

Even when an electric current having an intensity in excess of a value representing the intensity of a steady-state electric current such as a motor lock current or the like frequently flows through the fusible link, the fusible link exhibits excellent durability while keeping a stable pre-arcing time/current characteristic stable. Conclusively, the present invention has provided an inexpensive delay-breaking fuse which assures that the housing is not thermally deformed, and moreover, the color of the housing is not changed to other one.

What is claimed is:

1. A fusible link assembly comprising:

a fuse element including:

a pair of base plates disposed in parallel to each other, a fusible member respectively connected at opposite ends thereof to said base plates, and a heat radiator member extending from each of said base plates for radiating heat from the fusible member, the heat radiator member being disposed adjacent said fusible member and integral thereto; and a housing for receiving the fuse element to fix the fuse element therein.

2. A fusible link assembly as claimed in claim 1, wherein the heat radiator member includes a heat radiation fin defined by cutting out a part of heat radiator member.

3. A fusible link assembly as claimed in claim 1, further comprising:

engaging member provided on the base plates, respectively, to restrict a position of the base plates.

4. A fuse element comprising:

a pair of base plates located parallel to each other;

a fusible member respectively connected at opposite ends thereof to said fuse plates and a heat radiator member extending from each of said base plates for radiating heat from the fusible member, the heat radiator member being disposed adjacent said fusible member and integral thereto.

5. A fuse element as claimed in claim 4, wherein the heat radiator member includes a heat radiation fin defined by cutting out a part of heat radiator member.

6. A fuse element as claimed in claim 4, further comprising:

engaging member provided on the base plates, respectively, to restrict a position of the base plates.

7. The fusible link assembly of claim 1, wherein said heat radiating member is a plate-like member.

8. The fusible link assembly of claim 1, wherein said heat radiating member is unitary to said fusible member.

9. The fuse element of claim 4, wherein said heat radiating member is a plate-like member.

10. The fuse element of claim 4, where said heat radiating member is unitary to said fusible member.

* * * * *